United States Patent [19]

Amemiya et al.

[11] 4,223,065

[45] Sep. 16, 1980

[54] ANTI-GRAYING FABRICS OF SYNTHETIC POLYESTER FIBERS AND PROCESS FOR PRODUCING SAME

[75] Inventors: Kunio Amemiya, Kyoto; Motohiro Nishimura, Uji; Yoichi Kimura, Joyo, all of Japan

[73] Assignee: Unitika Ltd, Hyogo, Japan

[21] Appl. No.: 955,919

[22] Filed: Oct. 30, 1978

[30] Foreign Application Priority Data

Nov. 8, 1977 [JP] Japan ..... 52-134442
Aug. 16, 1978 [JP] Japan ..... 53-100324

[51] Int. Cl.[2] ..... D06M 15/12; D06M 15/66

[52] U.S. Cl. ..... 428/272; 260/29.4 R; 427/381; 427/387; 427/393.1; 428/290; 428/447

[58] Field of Search ..... 8/115.6; 427/390 B; 260/29.4 R; 428/272

[56] References Cited

U.S. PATENT DOCUMENTS

| | | | |
|---|---|---|---|
| 2,937,155 | 5/1960 | Eastes et al. | 428/266 X |
| 3,351,622 | 11/1967 | Tesoro | 8/115.6 X |
| 3,563,795 | 2/1971 | Williams et al. | 428/272 X |
| 3,606,991 | 9/1971 | Harper et al. | 8/115.6 |
| 3,637,427 | 1/1972 | Tsuruta et al. | 428/272 X |
| 3,801,546 | 4/1974 | Petersen et al. | 260/29.4 R X |
| 3,829,288 | 8/1974 | Deiner et al. | 8/115.6 |
| 3,983,272 | 9/1976 | Huber et al. | 428/266 X |
| 3,984,367 | 10/1976 | Pearson | 260/29.4 R |
| 4,152,273 | 5/1979 | Weiland | 8/115.6 |

FOREIGN PATENT DOCUMENTS

| | | | |
|---|---|---|---|
| 2708650 | 8/1978 | Fed. Rep. of Germany | 8/115.6 |

*Primary Examiner*—Sandra M. Person
*Attorney, Agent, or Firm*—Whittemore, Hulbert & Belknap

[57] ABSTRACT

A process for rendering polyester fabrics free of graying during dry-cleaning by applying to the fabric an aqueous solution, aqueous dispersion or emulsion comprising a polysiloxane resin, a melamine resin and an antistatic agent which is easily removable by dry cleaning, thereafter drying the fabric and heat-treating the resulting fabric.

6 Claims, No Drawings

ANTI-GRAYING FABRICS OF SYNTHETIC POLYESTER FIBERS AND PROCESS FOR PRODUCING SAME

The present invention relates to fabrics made of synthetic polyester fibers and prevented from graying when subjected to dry cleaning, and to a process for producing such anti-graying fabrics.

When dry-cleaned, textile articles of synthetic polyester fibers accidentally become soiled especially markedly when the product is white or of light color. This phenomenon is called graying. The graying phenomenon occurs when soil particles accumulated in the dry cleaning bath are redeposited on polyester fibers. The dry cleaning bath, which is a solvent, is inferior to aqueous washing baths in soil suspending ability and therefore fails to hold soil particles fully dispersed therein after they have been removed from the textile article, thus permitting redeposition of soil on polyester fibers, i.e. graying. The resulting soil is not readily removable, presenting difficulty in restoring the soiled article to the original state.

To avoid graying during dry cleaning, it is practiced, for example, to clean articles of light color and lesser degree of soiling and markedly soiled articles separately, but despite the care taken, graying accidentally occurs, giving rise to complaints.

We have long conducted extensive research on various fiber treating agents in an attempt to produce improved fabrics of synthetic polyester fibers which can be dry-cleaned free of graying.

Stated more specifically, we carried out experiments on almost all fiber treating agents to clarify the correlation between the fiber treating agents and graying attendant on dry cleaning. Our experiments revealed that most of the treating agents promote graying and that those of higher polarity such as durable cationic antistatic agents are more likely to cause graying, rendering fibers very liable to soiling, whereas conversely treating agents of lower polarity are less likely to cause graying. In fact, we found that polysiloxane resin and melamine resin are appreciably effective in inhibiting the graying resulting from dry cleaning. Subsequent research conducted further revealed that antistatic agents which are readily removable by dry cleaning, when used conjointly with polysiloxane resin and melamine resin, unexpectedly produce outstanding graying preventing effects. Thus this invention has been accomplished.

An object of the present invention is to provide a process for producing an anti-graying fabric of synthetic polyester fiber by applying to the fabric an aqueous solution, aqueous dispersion or emulsion comprising a mixture of a polysiloxane resin, a melamine resin and an antistatic agent easily removable by dry cleaning, thereafter drying the fabric and heat-treating the resulting fabric. Another object of the invention is to provide anti-graying fabrics produced by this process.

More specifically, this invention provides a process for producing an anti-graying fabric of synthetic polyester fiber by applying to the fabric an emulsion comprising in mixture a polysiloxane resin, an alkyletherified methylolmelamine resin and a metal salt of phosphoric acid ester, the polysiloxane resin being composed of dimethyl polysiloxane having a hydroxyl group attached directly to a terminal silicon atom and/or methylhydrogen polysiloxane, drying the resulting fabric and heat-treating the dried fabric. The invention also provides anti-graying fabrics produced by the above process.

The polysiloxane resins useful in this invention comprise dimethyl polysiloxane having a hydroxyl group attached directly to a terminal silicon atom and represented by the formula

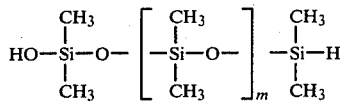

wherein m is an integer of 30 to 500, or methylhydrogen polysiloxane of the formula

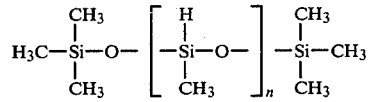

wherein n is an integer of 10 to 80, or a mixture of these polysiloxanes. Such polysiloxane resins are most effective in inhibiting graying, whereas other polysiloxane resins have somewhat inferior graying preventing effects.

It is suitable that the dimethyl polysiloxane be of an average polymerization degree of 30 to 500. If the average polymerization degree is less than 30, the resin per se is unstable, whereas if it is more above 500, the resin will have too high a viscosity and is not usable.

The methylhydrogen polysiloxane should have an average polymerization degree of 10 to 80 for use in this invention. When the average polymerization degree is less than 10, the resin is excessively reactive and therefore unstable, while it is difficult to produce such resin having an average polymerization degree of more than 80.

According to this invention, the polysiloxane resin must be used in an amount of 0.05% to 2% based on the weight of the fiber although the amount varies with the kind of the resin used and the form of the article to be treated. With less than 0.05% of the resin present, a satisfactory graying preventing effect is not available, whereas use of more than 2% of the resin will not give any improved effect but is liable to produce adverse effects such as a reduced slipping property.

Examples of useful melamine resins are alkyletherified methylolmelamine resins which produce the highest graying preventing effect. Among these resins, methyletherified methylolmelamine of the formula

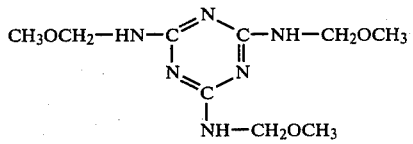

is advantageous to use in view of stability and reactivity involved in processing.

The alkyletherified methylolmelamine resin must be used in an amount of 0.05% to 5% based on the weight of the fiber. Use of less than 0.05% of the resin fails to achieve a sufficient anti-graying effect, whereas use of more than 5% of the resin will result in reduced antistatic properties and poor hand.

The hand of the article to be treated is adjustable by varying the proportions of polysiloxane resin and melamine resin used. Soft hand is available with a relatively larger amount of polysiloxane resin, while use of an increased amount of melamine resin gives stiff hand to the fabric treated.

In order to give fabrics sustained graying preventing properties resistant to repeated dry cleaning, it is preferable according to this invention to use a catalyst for each of the polysiloxane resin and melamine resin conjointly therewith. Examples of suitable catalysts for the polysiloxane resin are organic salts of metals such as tin, lead and zinc. Examples of useful catalysts for the melamine resin are organic amine salts and inorganic metal salts.

Synthetic polyester fibers tend to become electrostatically charged and involve difficulty in sewing operation unless treated with an antistatic agent. Our research has revealed that whereas use of almost all antistatic agents leads to enhanced graying due to dry cleaning, metal salts of phosphoric acid esters useful in this invention cause no graying.

Useful metal salts of phosphoric acid esters of this invention are metal salts of phosphoric acid monoesters and/or phosphoric acid diesters of at least one of the following compounds:

(1) Alcohols of the formula $R_1$—OH wherein $R_1$ is alkyl having 6 to 40 carbon atoms, (2) alcohol-ethylene oxide adducts of the formula $R_2$—$OCH_2(CH_2CH_2O)_lCH_2OH$ wherein $R_2$ is alkyl having 6 to 30 carbon atoms, and l is zero or an anteger of 1 to 30, (3) Alkylphenol-ethylene oxide adducts of the formula

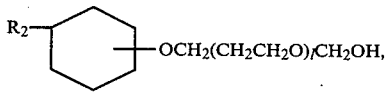

(4) Fatty acid-ethylene oxide adducts of the formula $R_2COOCH_2(CH_2CH_2O)_lCH_2OH$, (5) Fatty acid amide-ethylene oxide adducts of the formula $R_2CONH.CH_2(CH_2CH_2O)_lCH_2OH$, and (6) Amine-ethylene oxide adducts of the formula $R_2NH.CH_2(CH_2CH_2O)_lCH_2OH$ When the number of carbon atoms contained in the alkyl given above is less than the specified range, the metal salt fails to give sufficient antistatic properties, whereas even with the presence of carbon atoms exceeding the specified range in number, the salt produces little or no improved effect. With an increase in the number of moles of the ethylene oxide incorporated in the compound, the graying preventing effect of the resulting agent will reduce.

The metal salt of phosphoric acid ester of this invention must be used in an amount of 0.1% to 2% based on the weight of the fiber. If the amount is less than 0.1%, satisfactory antistatic properties will not be available, whereas even if the amount exceeds 2%, improved results will not be obtained.

The emulsion of this invention comprising a polysiloxane resin, an etherified methylolmelamine resin and a metal salt of phosphoric acid ester is applied to a fabric of synthetic polyester fiber by immersing the fabric in the emulsion and squeezing the immersed fabric, or by spraying the emulsion to the fabric. The resulting fabric is dried and thereafter heat-treated at a temperature of 150° C. to 200° C. for 20 seconds to 2 minutes although the heat-treating conditions are dependent on the polysiloxane resin, melamine resin and catalysts used.

The process of this invention will be described below with reference to examples, in which fabrics were tested for anti-graying properties by the following methods.

Laboratory test

(1) Dry cleaning method

Three pieces of specimen, 10 cm×10 cm, were placed into a pint jar along with 1 g of the below-mentioned soiling agent, 2 g of charge soap, 0.2 g of water and 200 cc of perchloroethylene, and the fabric was dry-cleaned at 40° C. for 1 hour using a Launder-Ometer. The specimen was then rinsed with fresh perchloroethylene, the solvent removed from the specimen, and the specimen dried. The resulting specimen was evaluated by the method given below.

The soiling agent was prepared by mixing together the following soils (1) to (4) in the ratio of 1:2:3:1.

(1) Distillation residue of solvent collected at a dry cleaner.

(2) Artificial oily soil comprising a mixture of stearic acid (15%), oleic acid (15%), hardened tallow oil (15%), olive oil (15%), cetyl alcohol (10%), cholesterol (5%) and solid paraffin (25%).

(3) Soil collected from a household vacuum cleaner.

(4) Carbon black.

(2) Method of evaluation (soiling degree)

The reflectance of the specimen fabric was measured at a wavelength of 480 mμ before and after the dry cleaning procedure. Soiling degree was calculated from the following equation:

$$\text{Soiling degree (\%)} = \frac{R_0 - R_1}{R_0} \times 100$$

Test at dry cleaner

Pieces of finished fabric were connected together and dry-cleaned three times at a dry cleaner. For evaluation, the soiling degree of the specimen was calculated in the same manner as above.

In the following examples, the parts are all by weight.

EXAMPLE 1

A twill fabric made of finished polyester yarns (150 denier, 48 filaments) was subjected to relax scouring, dyed in a fluorescent color and dried in the usual manner to obtain 20 specimens.

The specimens were immersed respectively in the baths of Formulations 1 to 20 given below, uniformly squeezed to 75%, dried at 100° C. for 3 minutes and further heat-treated at 170° C. for 30 seconds. Formulation 1 is according to the process of this invention, and Formulations 2 to 20 are comparison examples. Formulations 2 and 3 contain only one of the polysiloxane resin and melamine resin of the present invention, Formulations 4 to 14 are usual fiber treating agents, and Formulations 15 to 20 are various antistatic agents tested for comparison purposes.

| | |
|---|---|
| Formulation 1 | |
| Polysiloxane resin A (polysiloxane resin emulsion comprising 20% of dimethyl polysiloxane (average polymerization degree:210) having a hydroxyl group attached directly to a terminal silicon atom and 20% of methylhydrogen polysiloxane (average polymerization degree: 40) ) | 3 parts |
| Catalyst CZ (catalyst for polysiloxane resins, product of Shin-etsu Chemical Industry Co., Ltd., Japan) | 0.3 part |
| Methyletherified trimethylolmelamine | 7 parts |
| Hydrochloride of alkanolamine (40% aqueous solution, catalyst for melamine resins) | 0.7 part |
| Sodium salt of lauryl phosphate (mixture of monoester and diester) | 5 parts |
| Water | 984 parts |
| Formulation 2 | |
| Polysiloxane resin A | 10 parts |
| Catalyst OZ | 1 part |
| Water | 989 parts |
| Formulation 3 | |
| Methyletherified trimethylolmelamine | 10 parts |
| Hydrochloride of alkanolamine | 1 part |
| Water | 989 parts |
| Formulation 4 | |
| Butyl polyacrylate (about 60 in polymerization degree, 40% emulsion) | 10 parts |
| Water | 990 parts |
| Formulation 5 | |
| Polyethylene resin (about 60 in polymerization degree, 40% emulsion) | 10 parts |
| Water | 990 parts |
| Formulation 6 | |
| Dimethyloldihydroxyethyleneurea | 10 parts |
| Zinc nitrate | 1 part |
| Water | 989 parts |
| Formulation 7 | |
| Poval (500 in polymerization degree, 88 in saponification value) | 10 parts |
| Water | 990 parts |
| Formulation 8 | |
| Ethylene glycol diglycidyl ether (epoxy resin) | 10 parts |
| Zinc borofluoride | 1 part |
| Water | 989 parts |
| Formulation 9 | |
| tris(2,3-Dibromopropyl)phosphate (40% emulsion, flame retardant) | 10 parts |
| Water | 990 parts |
| Formulation 10 | |
| Polycondensation product (polymerization degree: 6, hygroscopic processing agent) of polyethylene gycol (molecular weight: 1500) and terephthalic acid | 10 parts |
| Water | 990 parts |
| Formulation 11 | |
| Prymal HA 24 (polyacrylic resin, product of Nippon Akuriru Kagaku Co., Ltd., Japan) | 10 parts |
| Water | 990 parts |
| Formulation 12 | |
| Saibinol PN-3500 (polyethylene resin, product of Saiden Kagakukogyo Co., Ltd. Japan) | 10 parts |

-continued

| | |
|---|---|
| Water | 990 parts |
| Formulation 13 | |
| Elastron CT-4 (polyurethane resin, product of Dai-ichi Kogyo Seiyaku Co., Ltd., Japan) | 10 parts |
| Catalyst 32 (catalyst for polyurethane resins, product of Dai-ichi Kogyo Seiyaku Co., Ltd., Japan) | 1 part |
| Water | 989 parts |
| Formulation 14 | |
| Asahiguard AG 730 (fluorocarbon resin, product of Asaki Glass Co., Ltd., Japan) | 10 parts |
| Water | 990 parts |
| Formulation 15 | |
| Sodium salt of lauryl phosphate (mixture of mono- and di-esters) | 5 parts |
| Water | 995 parts |
| Formulation 16 | |
| Sodium salt of cetyl sulfate | 10 parts |
| Water | 990 parts |
| Formulation 17 | |
| Dinonyldimethylbenzyl ammonium salt | 10 parts |
| Water | 990 parts |
| Formulation 18 | |
| Sorbitan stearic acid ester-ethylene oxide adduct (with 4 moles of oxide adducted) | 10 parts |
| Water | 990 parts |
| Formulation 19 | |
| Nonax 1166 (durable antistatic agent, product of Henkel Hakusui Co., Ltd., Japan) | 10 parts |
| Water | 990 parts |
| Formulation 20 | |
| Aston 20 (durable antistatic agne, product of Onyx Chemical Co., U.S.A.) | 10 parts |
| Water | 990 parts |

Table 1 shows the anti-graying and antistatic properties of the specimens thus treated and of the untreated specimen as finished by dyeing.

The specimens were tested for antistatic property by the following method. The specimen was heated at 105° C. to dryness for 1 hour and then allowed to stand in an atmosphere of 20° C. and 40% RH for 48 hours. Half-value period measurements were made with use of Honest meter (product of Shishido Shokai Co., Ltd., Japan) at a rotary blade speed of 1730 r.p.m. and with application of voltage at 10000 V.

Table 1 reveals that the specimen obtained by the process of this invention alone is outstanding in anti-graying and antistatic properties.

Table I

| Specimen (Formulation No. | Soiling degree (%) | | Antistatic property |
|---|---|---|---|
| | Laboratory | Dry cleaner | Half-value period (seconds) |
| Untreated | 42.1 | 25.4 | At least 100 |
| 1 | 5.8 | 1.7 | 1.5 |
| 2 | 32.9 | 20.4 | At least 100 |
| 3 | 35.2 | 21.1 | At least 100 |
| 4 | 61.2 | 41.4 | At least 100 |
| 5 | 63.1 | 40.6 | At least 100 |
| 6 | 44.2 | 29.8 | At least 100 |
| 7 | 58.4 | 35.7 | 57.9 |
| 8 | 69.2 | 50.4 | 3.2 |
| 9 | 67.7 | 48.4 | 12.8 |
| 10 | 68.5 | 51.6 | 4.7 |
| 11 | 63.1 | 45.7 | At least 100 |
| 12 | 60.2 | 43.9 | At least 100 |
| 13 | 64.1 | 45.1 | At least 100 |

Table I-continued

| Specimen (Formulation No. | Soiling degree (%) Laboratory | Soiling degree (%) Dry cleaner | Antistatic property Half-value period (seconds) |
|---|---|---|---|
| 14 | 58.6 | 40.5 | At least 100 |
| 15 | 40.8 | 23.7 | 1.2 |
| 16 | 57.7 | 39.3 | 6.5 |
| 17 | 61.4 | 44.2 | 1.5 |
| 18 | 63.1 | 46.2 | 1.0 |
| 19 | 68.9 | 55.7 | 1.2 |
| 20 | 69.2 | 56.1 | 1.2 |

Note: The specimen with Formulation No. 1 is according to the process of this invention, and specimens with Formulation No. 2 to No. 20 are comparison examples.

EXAMPLE 2

A plain weave fabric made of finished polyester yarns (150 denier, 30 filaments) was scoured, dyed in a fluorescent color and dried in the usual manner. The specimen thus obtained was then immersed in a bath of Formulation 21 given below, uniformly squeezed to 80%, dried at 100° C. for 3 minutes and further heat-treated at 180° C. for 30 seconds.

| Formulation 21 | |
|---|---|
| Polysiloxane resin B (polysiloxane resin emulsion comprising 30% of dimethyl polysiloxane (average polymerization degree: 530) having a hydroxyl group attached directly to a terminal silicon atom) | 10 parts |
| Catalyst OZ | 1 part |
| Methyletherified trimethylolmelamine | 2 parts |
| Hydrochloride of alkanolamine (40% aqueous solution) | 0.2 part |
| Sodium salt of phosphoric acid ester of octyl alcohol-ethylene oxide adduct (with 3 moles oxide adducted, mixture of mono- and di-esters) | 5 parts |
| Water | 981.8 parts |

Table 2 shows the properties of the treated specimen thus obtained and of the specimen as finished by dyeing (untreated fabric). Table 2 shows that the specimen obtained by the process of the invention is outstanding in anti-graying and antistatic properties.

Table 2

| Specimen (Formulation No.) | Soiling degree (%) Laboratory | Soiling degree (%) Dry cleaner | Antistatic property Half-value period (seconds) |
|---|---|---|---|
| Untreated | 50.2 | 27.9 | At least 100 |
| 21 | 3.6 | 1.1 | 1.0 |

EXAMPLE 3

A half tricot made of polyester filament yarns (75 denier, 24 filaments) was scoured, dyed in a fluorescent color and dried in the usual manner. The specimen thus obtained was then immersed in a bath of Formulation 22 given below, uniformly squeezed to 100%, dried at 110° C. for 2 minutes and further heat-treated at 160° C. for 1 minute.

| Formulation 22 | |
|---|---|
| Polysiloxane resin C (polysiloxane resin emulsion comprising 40% of methylhydrogen polysiloxane (average polymerization degree: 30)) | 5 parts |

-continued

| Formulation 22 | |
|---|---|
| Catalyst OZ | 0.5 part |
| Methyletherified trimethylolmelamine | 1 part |
| Hydrochloride of alkanolamine (40% aqueous solution) | 0.1 part |
| Sodium salt of phosphoric acid ester of octyl phenol-ethylene oxide adduct (with 6 moles of oxide adducted, mixture of mono- and di-esters) | 5 parts |
| Water | 988.4 parts |

Table 3 shows the properties of the treated specimen thus obtained and of the specimen as finished by dyeing (untreated fabric). Table 3 reveals that the specimen obtained by the process of the invention is outstanding in anti-graying and antistatic properties.

Table 3

| Specimen (Formulation No.) | Soiling degree (%) Laboratory | Soiling degree (%) Dry cleaner | Antistatic property Half-value value period (seconds) |
|---|---|---|---|
| Untreated | 36.4 | 20.3 | At least 100 |
| 22 | 1.5 | 0.5 | 1.0 |

EXAMPLE 4

The same polyester fabric as used in Example 1 was scoured, dyed in a fluorescent color and dried in the same manner as in Example 1. The specimen obtained was immersed in a bath of Formulation 23 given below, then squeezed, dried and heat-treated in the same manner as in Example 1.

| Formulation 23 | |
|---|---|
| Polysiloxane resin A (same as one used in Example 1) | 3 parts |
| Catalyst OZ | 0.3 part |
| Methyletherified trimethylolmelamine | 7 parts |
| Hydrochloride of alkanolamine | 0.7 part |
| Sodium salt of phosphoric acid ester of stearic acid-ethylene oxide adduct (with 12 moles of oxide adducted, mixture of mono- and di-esters) | 5 parts |
| Water | 984 parts |

The properties of the treated specimen are shown in Table 4, which reveals that the specimen obtained by the process of the invention is outstanding in anti-graying and antistatic properties.

EXAMPLE 5

The same polyester fabric as used in Example 1 was scoured, dyed in a fluorescent color and dried in the same manner as in Example 1. The specimen obtained was immersed in a bath of Formulation 24 given below, then squeezed, dried and heat-treated in the same manner as in Example 1.

| Formulation 24 | |
|---|---|
| Polysiloxane resin A (same as one used in Example 1) | 3 parts |
| Catalyst OZ | 0.3 part |
| Methyletherified trimethylolmelamine | 7 parts |
| Hydrochloride of alkanolamine | 0.7 part |
| Sodium salt of phosphoric acid ester of palmitic acid amide-ethylene oxide adduct (with 3 moles of oxide adducted, mixture of mono- and di-esters) | 5 parts |

-continued

| Formulation 24 | |
|---|---|
| Water | 984 parts |

The properties of the treated specimen are shown in Table 4, which reveals that the specimen obtained by the process of the invention is outstanding in anti-graying and antistatic properties.

EXAMPLE 6

The same polyester fabric as used in Example 1 was scoured, dyed in a fluorescent color and dried in the same manner as in Example 1. The specimen obtained was immersed in a bath of Formulation 25 given below, then squeezed, dried and heat-treated in the same manner as in Example 1.

| Formulation 25 | |
|---|---|
| Polysiloxane resin A (same as one used in Example 1) | 3 parts |
| Catalyst OZ | 0.3 part |
| Methyletherified trimethylolmelamine | 7 parts |
| Hydrochloride of alkanolamine | 0.7 part |
| Sodium salt of phosphoric acid ester of dodecylamine-ethylene oxide adduct (with 6 moles of oxide adducted, mixture of mono- and di-esters) | 5 parts |
| Water | 984 parts |

The properties of the treated specimen are shown in Table 4, which reveals that the specimen obtained by the process of this invention is outstanding in anti-graying and antistatic properties.

Table 4

| | Soiling degree (%) | | Antistatic property Half-value period |
|---|---|---|---|
| Specimen | Laboratory | Dry cleaner | (seconds) |
| Example 4 | 6.2 | 2.1 | 1.0 |
| Example 5 | 6.0 | 1.8 | 1.0 |
| Example 6 | 7.5 | 2.6 | 1.0 |

What we claim is:

1. A process for producing an anti-graying fabric of synthetic polyester fiber by applying to the fabric an aqueous solution, aqueous dispersion or emulsion comprising in mixture a polysiloxane resin comprising dimethyl polysiloxane having a hydroxyl group attached directly to a terminal silocon atom or methylhydrogen polysiloxane or a mixture of the polysiloxanes, a melamine resin consisting of an alkyletherified methylolmelamine resin, and an antistatic agent consisting of a metal salt or phosphoric acid ester which is easily removable by dry cleaning, thereafter drying the fabric and heat-treating the resulting fabric.

2. A process as defined in claim 1, wherein the antistatic agent comprises a metal salt of phosphoric acid monoester of at least one compound, or a metal salt of phosphoric acid diester of the compound, or a mixture of the metal salts, said compound being a $C_6$–$C_{40}$ higher alcohol, and adduct of $C_6$–$C_{30}$ higher alcohol and ethylene oxide, an adduct of $C_6$–$C_{30}$ alkylphenol and ethylene oxide, an adduct of $C_6$–$C_{30}$ higher fatty acid and ethylene oxide, an adduct of $C_6$–$C_{30}$ higher fatty acid amide and ethylene oxide, or an adduct of $C_6$–$C_{30}$ higher fatty amine and ethylene oxide.

3. A process as defined in claim 1 wherein the polysiloxane resin comprises dimethyl polysiloxane having a hydroxyl group attached directly to a terminal silicon atom and an average polymerization degree of 30 to 500, or methylhydrogen polysiloxane having an average polymerization degree of 10 to 80, or a mixture of the polysiloxanes; the melamine resin is an alkyletherified methylolmelamine resin; and the antistatic agent comprises a metal salt of phosphoric acid monoester of at least one compound, or a metal salt of phosphoric acid diester of the compound, or a mixture of the metal salts, said compound being a $C_6$–$C_{40}$ higher alcohol, an adduct of $C_6$–$C_{30}$ higher alcohol and ethylene oxide in the mole ratio of 1:1–30, an adduct of $C_6$–$C_{30}$ alkylphenol and ethylene oxide in the mole ratio of 1:1–30, an adduct of $C_6$–$C_{30}$ higher fatty acid and ethylene oxide in the mole ratio of 1:1–30, an adduct of $C_6$–$C_{30}$ higher fatty acid amide and ethylene oxide in the mole ratio of 1:1–30, or an adduct of $C_6$–$C_{30}$ higher fatty amine and ethylene oxide in the mole ratio of 1:1–30.

4. A process as defined in claim 1 or 2 or 3, wherein 0.05% to 2% of the polysiloxane resin 0.05% to 5% of the malamine resin and 0.1% to 2% of the antistatic agent are applied to the fabric based on the weight of the fiber.

5. A process as defined in claim 1 or 2 or 3, wherein the heat treating is conducted at a temperature of 150° C. to 200° C.

6. An anti-graying fabric of synthetic polyester fiber produced by immersing the fabric in an emulsion comprising a polysiloxane resin, an alkyletherified methylolmelamine resin and an antistatic agent to apply the fabric 0.05% to 2% of a polysiloxane resin, 0.05% to 5% of an alkyletherified methylolmelamine resin and 0.1% to 2% of an antistatic agent based on the weight of the fiber, thereafter drying the fabric and heat-treating the resulting fabric at a temperature of 150° C. to 200° C.; said polysiloxane resin comprising dimethyl polysiloxane having a hydroxyl group attached directly to a terminal silicon atom and an average polymerization degree of 30 to 500, or methylhydrogen polysiloxane having an average polymerization degree of 10 to 80, or a mixture of the polysiloxanes; said antistatic agent comprising a metal salt of phosphoric acid monoester of at least one compound, or a metal salt of phosphoric acid diester of the compound, or a mixture of the metal salts, said compound being a $C_6$–$C_{40}$ higher alcohol, an adduct of $C_6$–$C_{30}$ higher alcohol and ethylene oxide in the mole ratio of 1:1–30, an adduct of $C_6$–$C_{30}$ alkylphenol and ethylene oxide in the mole ratio of 1:1–30, an adduct of $C_6$–$C_{30}$ higher fatty acid and ethylene oxide in the mole ratio of 1:1–30, an adduct of $C_6$–$C_{30}$ higher fatty acid amide and ethylene oxide in the mole ratio of 1:1–30, or an adduct of $C_6$–$C_{30}$ higher fatty amine and ethylene oxide in the mole ratio of 1:1–30.

* * * * *